United States Patent [19]

Smith

[11] Patent Number: 4,964,025

[45] Date of Patent: Oct. 16, 1990

[54] NONIMAGING LIGHT SOURCE

[75] Inventor: George E. Smith, San Jose, Calif.

[73] Assignee: Hewlett-Packard Company, Palo Alto, Calif.

[21] Appl. No.: 429,973

[22] Filed: Nov. 1, 1989

Related U.S. Application Data

[63] Continuation-in-part of Ser. No. 254,349, Oct. 5, 1988.

[51] Int. Cl.[5] ..... F21V 7/00

[52] U.S. Cl. ..... 362/346; 362/297; 362/347; 362/800; 357/17; 357/70

[58] Field of Search ..... 362/297, 298, 302, 346, 362/347, 800; 357/17, 69, 70

[56] References Cited

U.S. PATENT DOCUMENTS 4,225,903 9/1980 Buchleitner ..... 362/346 X
4,481,563 11/1984 Snyder et al. ..... 362/346 X
4,730,240 3/1928 Van Meel et al. ..... 362/346

FOREIGN PATENT DOCUMENTS 159809 4/1983 Fed. Rep. of Germany ..... 362/346

*Primary Examiner*—Stephen F. Husar
*Assistant Examiner*—Peggy A. Neils

[57] ABSTRACT

The principles of nonimaging optics, rather than imaging optics, are used to provide an asymmetrical flux extraction cup for an LED illumination lamp that has an asymmetrical limited viewing angle or cutoff angle. The cup has a flat section in the bottom normal to the optical axis, for attachment of the LED. In a cross section of one side of the cup, there is a circular section extending from the flat section to a lower point located at an intersection with a line from the opposite cup lip through a nearest edge point of a top surface of an envelope in which the LED is positioned. Next is a lower parabolic section extending from the lower point to an upper point located at an intersection with a projection of the top surface of the positioning envelope. The lower parabolic section has a vertex at the lower point, an axis projecting through the nearest edge point and the lower point, and a focus at the nearest edge point. Then there is an upper parabolic section extending from the upper point to the cup lip. The upper parabolic section has a vertex at the cup lip, an axis extending through the farthest edge point and parallel to the axis of the lower parabolic section, and a focus located at the farthest edge point of the top surface of the positioning envelope.

12 Claims, 2 Drawing Sheets

NONIMAGING LIGHT SOURCE

CROSS REFERENCE TO RELATED APPLICATION

This application is a continuation in part of U.S. patent application Ser. No. 07/254,349, filed Oct. 5, 1988, pending and entitled "Nonimaging Light Source".

BACKGROUND

Light emitting diodes (LEDs) are becoming increasingly widely used in automobile design because of their longer lives and lower repair cost compared to the incandescent bulbs they replace. Present day automotive designers are specifying LEDs not only for indicator lamps and alphanumeric displays but also for high power illumination lamps such as center with mounted stop lights. LED stop lights require very high brightness, but only over a limited viewing angle.

In order to be cost competitive with incandescent bulbs, an LED stop light must contain only a minimum number of individual LED lamps. The number of individual lamps can only be minimized if each lamp extracts substantially all of the light flux from the LED chip and concentrates the light within the useful viewing angle. Light flux outside of the viewing angle is wasted and might have been available to increase brightness within the viewing angle.

Commercially available indicator lamps, which are designed according to the principles of imaging optics and standard manufacturing techniques, fail to concentrate sufficient light flux within the narrow required viewing angle. The imaging optics design constraint that the emitting surface is imaged by the viewing optics makes design of a cost effective LED illumination lamp using imaging optics very difficult.

An alternative design approach known as nonimaging optics has been used successfully in the design of high efficiency solar collectors. An additional degree of design freedom is available in nonimaging optics since there is no requirement that the emitting surface be imaged.

However, the design methods well known from the extensive literature on so-called ideal solar collectors or concentrators do not yield practical designs for high efficiency lamps. A practical collector design, when used as a lamp by replacing the absorber with the same size or larger emitter, as taught by the solar concentrator prior art, would result in trapping of a portion of the light flux from the emitter and thus lower lamp efficiency. The present design for the flux extractor cup for an LED lamp seeks higher efficiency not "ideality" in the solar collector sense.

BRIEF SUMMARY OF THE INVENTION

Thus, in accordance with a preferred embodiment of the present invention, the concepts of nonimaging optics are employed to provide a high efficiency flux extraction cup for an LED illumination source which may be useful in an automobile light such as a stoplight, for example. The lamp produces a very bright output over a preselected limited viewing angle or cutoff angle which is asymmetrical relative to the axis of the lamp. The asymmetrical flux extraction cup may provide light to a second stage which further directs the light in a desired direction by itself, or in conjunction with an optional lens stage.

The first stage of the lamp described herein is a flux extraction cup which supports the LED and concentrates its three dimensional light flux into a desired flux path asymmetrical relative to the optical axis of the cup. The shape of each side of the cross section of the cup is determined by a combination of geometric features of the height of the cup lip on the opposite sides of the cup, and the edges of the envelope within which the LED is mounted in the bottom of the cup.

The cup has a flat section at the bottom normal to the optical axis of the cup for attachment of the LED, the flat section having a diameter equal to a diameter of an envelope in which the LED is positioned. Next to the flat section there is a circular section extending from the flat section to a lower point located at an intersection with a line from the opposite cup lip through a nearest edge point of a top surface of the positioning envelope. The circular section has a constant radius and a center at the nearest edge point. Next is a lower parabolic section extending from the lower point to an upper point located at an intersection with a projection of the top surface of the positioning envelope. The lower parabolic section has a vertex at the lower point, an axis projecting through the nearest edge point and the lower point, and a focus at the nearest edge point. Next is an upper parabolic section extending from the upper point to the low cup lip. The upper parabolic section has a vertex at the cup lip, an axis extending through the farthest edge point and parallel to the axis of the lower parabolic section, and a focus located at the farthest edge point of the top surface of the positioning envelope.

DETAILED DESCRIPTION

Modern LED chips may be fabricated from GaAs, GaAsP, AlGaAs or other compounds and may use either absorbing or transparent substrates. Many of these chips are capable of emitting a Lambertian distribution of light flux from most, if not all, of the chip surfaces. To minimize input electrical power and to optimize efficiency, the lamp should extract and concentrate substantially all of the light flux rather than just that portion emitted by the LED top surface.

To meet brightness and angular viewing requirements for stop lights or other special applications where asymmetrical light patterns are desired, light flux of a certain brightness is concentrated within a specified viewing angle or cutoff angle. In many applications the lamp must provide an illuminated surface having a given area and a specified uniformity of brightness. In addition, it is often necessary to limit the overall height of the lamp because of physical mounting constraints. In a typical illumination application there is no requirement that the LED chip surface be imaged by the viewing optics.

An optimal LED illumination lamp would concentrate all of the light flux from the LED chip to create a maximum brightness within the desired viewing angle and zero brightness elsewhere. That area of illumination may not be symmetrical like the beam from an ordinary flashlight. It may be that it should be wider in a horizontal direction and narrower in a vertical direction, for example. It may be that the desired pattern of illumination is skewed to one side. That type of distribution may be achieved with a lamp with an asymmetrical reflector.

Figure 1:
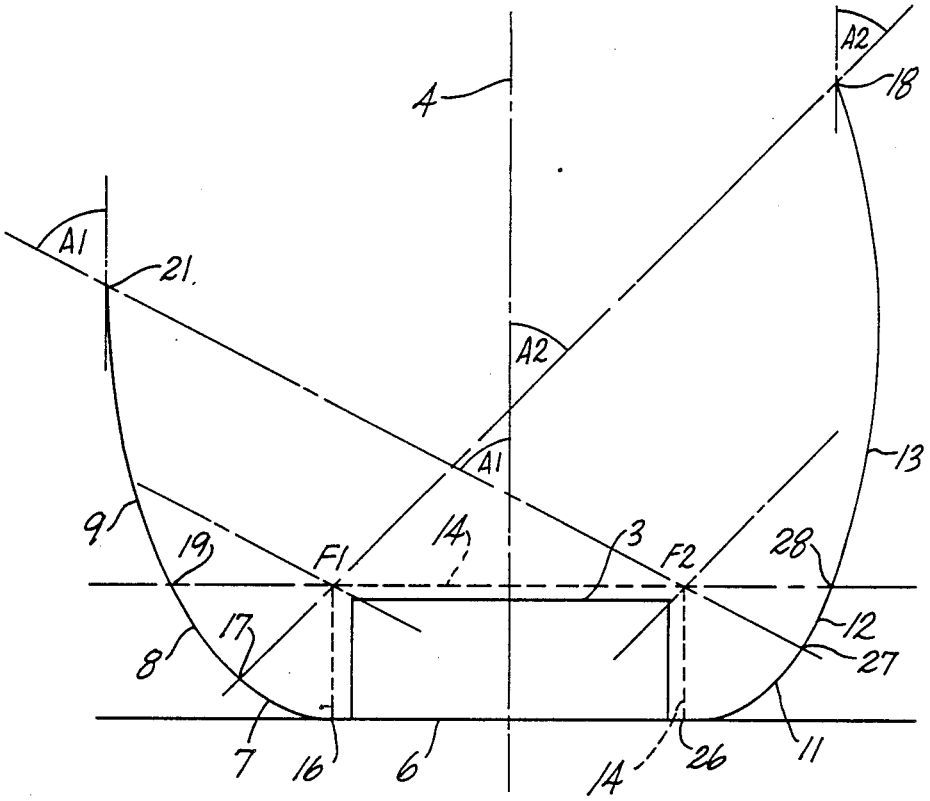
FIG. 1 shows in longitudinal cross section a flux extraction cup for an LED illumination lamp constructed in accordance with one embodiment of the present invention.

FIG. 1 shows a longitudinal cross section of an LED illumination lamp 1 that is constructed in accordance with a preferred embodiment of the present invention using the principles of nonimaging optics. The drawing indicates only the longitudinal cross section of the inside surface of a reflector cup of an LED lamp. Such a cup may be formed in the face of a metal body such as the end of a lead of the sort presently used in conventional LED lamps, or in a more or less flat surface having an array of LED lamps. Such a reflective cup may also be molded of plastic and have the inside surface metallized for high specular reflection. The construction of the cup is conventional and its internal shape as illustrated herein is novel.

The lamp is effective to conserve brightness and to maximize intensity by cutting off the flux at a desired angle, $A_1$ or $A_2$, at the lip of the flux extraction cup and retaining the reflected light within those angles. An LED chip 3 sits within a flux extractor cup 5 which is fabricated within a conventional lead frame or the like. A bond wire (not shown) is connected to the top of the LED chip for providing current to the LED. The bottom of the LED chip (the body of the chip) is electrically connected to the cup by conductive epoxy adhesion to the interior surface of the cup. Such electrical connections are conventional.

The size of such a flux extraction cup for an LED lamp is quite small. For example, the LED chip may be a 400 micrometer square by 250 micrometer high AlGaAs red LED chip. The drawing in FIG. 1 extends through a diagonal of such an LED. The balance of the cup is drawn approximately to the same scale to give an idea of the small size of the cup.

Light emitted by the LED chip 3 exits the cup within a cup cutoff angle $A_1$ from the optical axis 4 of the cup at one side of the cross section, and a cutoff angle of $A_2$ at the other side of the cross section. The cup includes four separate sections 6, 7, 8 and 9 on one side (the left side) of the cross section, and somewhat analogous four sections 6, 11, 12 and 13 on the opposite side (the right side) of the cross section. The flat bottom section 6 is present on both sides of the optical axis 4.

In this drawing of an asymmetrical cup, the lip of the cup on the right side is higher above the bottom of the cup than the lip on the left side. The cutoff angle $A_1$ of light from the cup is larger at the low side of the cup cross section than the cutoff angle $A_2$ at the higher side of the cup.

The LED chip 3 is attached to a flat bottom section 6 of the cup using an electrically conductive silver epoxy (not shown). The flat bottom section 6 is normal to the optical axis 4 and is slightly larger than the actual dimensions of the LED chip to allow for dimensional tolerances and slight manufacturing misalignment within an envelope 14. In order to avoid discontinuities, the projection of the envelope 14 onto the bottom of the cup may be circular even though the actual projection of the LED chip 3 is square. The envelope is cylindrical with a height equal to the nominal height or thickness of the LED chip plus its manufacturing and mounting tolerances, and a diameter equal to the diagonal of the LED chip plus the tolerances of the chip dimensions and placement of the chip in the bottom of the cup.

Referring first to the left side of the cross section, a circular section 7 extends from a point 16 at the edge of flat bottom section 6 to a point 17. This point 17 is determined as the projection of the cup cutoff angle $A_2$ from the higher lip 18 of the cup on the right side through the nearest top edge point $F_1$ of the envelope 14. Between points 16 and 17, the surface 7 of cup forms a segment of a circle having a constant radius and a center at the nearest top edge point $F_1$ of the envelope 14. That is, the surface intersects the plane of the cross section in a circular arc. Similar reference to the intersection of the surfaces with the cross sectional plane are made throughout the description and claims of this specification.

A lower parabolic section 8 extends from the point 17 to a point 19. The point 19 is located on the inner surface of the cup at the same distance above the flat bottom section 6 as the top surface of the envelope 14. The lower parabolic section 8 is formed as a parabola having its vertex at point 17, its axis projecting through point 17, the near edge point $F_1$ and the higher lip 18, and a focus at the near edge point $F_1$ of the envelope.

An upper parabolic section 9 extends from the point 19 to the lower lip 21 of the cup. The lower lip of the cup lies on the projection of the cup cutoff angle $A_1$ from the low edge of the cup through the far edge point $F_2$. The upper parabolic section 9 is formed as a parabola having an axis extending through the far edge point $F_2$ of the envelope and parallel to the axis of the lower parabolic section 8. The focus of the upper parabolic section 9 is located at the far edge point $F_2$.

Thus, the shape of the lower parabolic section 8 is determined by reference to the cutoff angle $A_2$ on the far side of the cup. The shape of the upper parabolic section 9 is determined by reference to an axis parallel to the axis of the lower parabolic section which is defined by the cut off angle $A_2$. The shape of the lower parabola on the left side is a function of the right cutoff angle $A_2$ and the shape of the upper parabola on the left side is a function of both cutoff angles.

A similar analysis is applicable to the opposite side of the cross section.

A circular section 11 extends from a point 26 at the edge of the flat bottom section 6 to a point 27. This point 27 is determined as the projection of the cup cutoff angle $A_1$ from the lower lip 21 of the cup on the left side through the nearest top edge point $F_2$ of the envelope 14. Between points 26 and 27, the surface 11 of cup forms a segment of a circle having a constant radius and a center at the nearest top edge point $F_2$ of the envelope.

A lower parabolic section 12 extends from the point 27 to a point 28. The point 28 is located on the inner surface of the cup at the same distance above the flat bottom section 6 as the top surface of the envelope 14. The lower parabolic section 12 is formed as a parabola having its vertex at point 27, its axis projecting through point 27, the near edge point $F_2$ and the lower lip 21, and a focus at the near edge point $F_2$ of the envelope.

An upper parabolic section 13 extends from the point 28 to the higher lip 18 of the cup. The higher lip of the cup lies on the projection of the cup cutoff angle $A_2$ from the high edge of the cup through the far edge point $F_1$. The upper parabolic section 13 is formed as a parabola having an axis extending through the far edge point $F_1$ of the envelope and parallel to the axis of the lower parabolic section 12. The focus of the upper parabolic section 13 is located at the far edge point $F_1$.

It will be noted that in this description, reference is made to the near and far edge points of the envelope. These refer to the edge of the cylindrical envelope at a point in the plane of the cross section nearer to or further from the shape of the cup wall being described. In other words, what might be considered a near edge point in one part of the description could be considered a far edge point in another part of the description when the opposite side of the cross section is being described.

Figure 2:
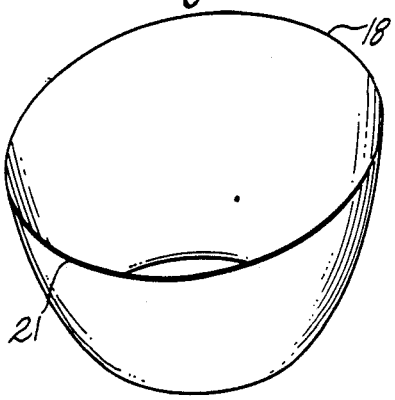
FIG. 2 illustrates in schematic perspective the general shape of one embodiment of lamp with a cross section as illustrated in FIG. 1.

In the embodiment described, the longitudinal cross section may all be in a single plane where there is a higher lip on one edge of the cup and a lower lip on the opposite edge of the cup. Such a cup is illustrated semi-schematically in FIG. 2. In this drawing the cup is illustrated as if it were a thin walled cup having an external shape the same as the internal shape. It will be apparent that this is solely for purposes of illustration and in a typical actual embodiment there would likely be very little relation between the internal and external shapes of such a cup.

In between the higher 18 and lower 21 portions of the lip of the cup, the shape of the interior surface of the cup may gradually change between the two cross-sectional shapes illustrated. The circular sections 7 and 11 adjacent to the flat base 6 in the bottom of the cup have the same radius all the way around the cup. The end of the circular section, however, varies between the points 17 and 27. The intersection 19, 20 between the lower parabolic section and the upper parabolic section is at the same distance above the flat base all the way around the cup since it is a projection of the top of the positioning envelope 14. The shapes of the upper and lower parabolic sections, however, gradually change between the shapes described and illustrated.

Such a cup shape projects light within a skewed pattern having a relatively smaller cutoff angle $A_2$ at the high side of the cup, a relatively larger cutoff angle $A_1$ at the lower side of the cup and an intermediate cutoff angle therebetween.

Figure 3:
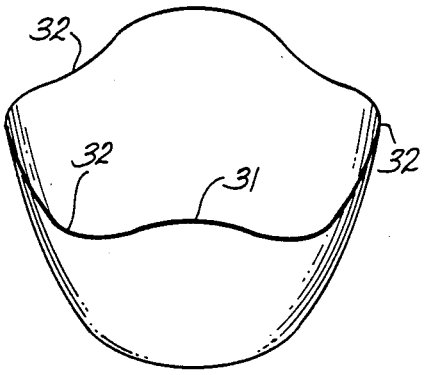
FIG. 3 illustrates in schematic perspective another embodiment of lamp with an asymmetrical cross section.

FIG. 3 illustrates another embodiment of cup for extracting and projecting a high proportion of flux from an LED or the like. Such an embodiment could be referred to as a tulip-shaped cup having four relatively higher crests 31 and four intervening relatively lower valleys 32 around the lip of the cup. Such a non-axisymmetric cup with cutoff angles going through four cycles around the rim may be used for illuminating a more or less square area. The shape of a planar cross section through the cup may be symmetrical. Thus, for example a longitudinal cross section through opposite crests has circular and parabolic cross sections on opposite sides of the axis which are substantially the same. Forty-five degrees around the cup the planar cross section would also be symmetrical, but the shapes of the parabolic sections through opposite valleys would be different from the cross section through opposite crests. The shapes of the sections are determined by reference to the opposite and adjacent lips and edge points of the envelope as described above. In between the crests and valleys the shapes can gradually change.

Figure 4:
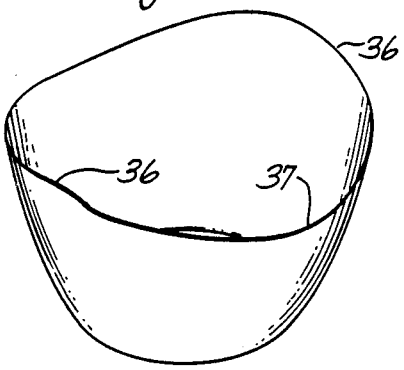
FIG. 4 illustrates in schematic perspective another embodiment of lamp with an asymmetrical cross section.

FIG. 4 illustrates another embodiment of cup which is not axisymmetric. In this embodiment there are a pair of crests 36 on opposite sides of the lip of the cup. In between the crests are valleys 37 which are also 180° apart. Such an embodiment provides illumination in a somewhat oval pattern. Thus, for example, with the cup axis horizontal and the crests 36 at the top and bottom, the illuminated pattern is relatively wider in a horizontal direction and relatively narrower in a vertical direction. The same rules for determining the shape of the inside surface of the cup are used as hereinabove described.

Cup shapes as provided in the embodiments of FIGS. 1 through 4 provide excellent flux extraction from the LED and projection within the illuminated area for rays lying in planes including the optical axis of the cup. There is Lambertian distribution of light emitted from the surfaces of the LED. Thus, there are rays which are not in the "axial" planes. There is good extraction and projection of such rays as well.

Figure 5:
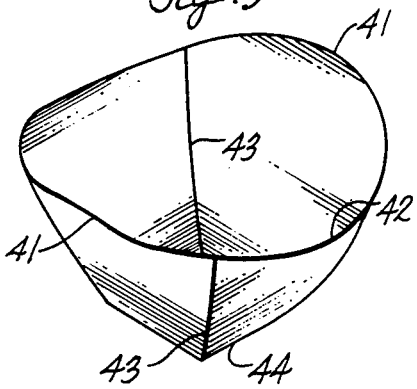
FIG. 5 shows in schematic perspective a variation of an embodiment as illustrated in FIG. 4.
Figure 6:
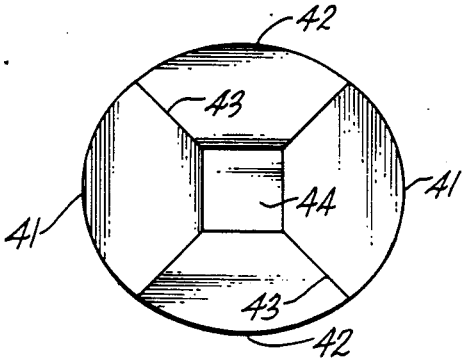
FIG. 6 is a view into the mouth of the cup illustrated in FIG. 5.

There may be situations where a non-axisymmetric cup and non-symmetrical illumination pattern can afford to have less efficient total light flux extraction and projection. This may be the case, for example, where the cost of making the most efficient cup would be excessive for the application and a lower efficiency can be accepted to provide lower manufacturing costs. The costs of making the coining dies or injection casting molds for the tiny parts of such cup may be too high unless there is an appreciable volume of parts to be made. If that is the case a cup may be made with a geometry somewhat as illustrated in FIGS. 5 and 6.

In this embodiment the lip of the cup has a pair of opposite crests 41 and a pair of opposite valleys 42 similar to the crests 36 and valleys 37 in the embodiment of FIG. 4. The shape of the interior surface of the cup in the axial planes through the crests and through the valleys are determined in the same general manner as hereinabove described. In between the crests and valleys there is a more abrupt transition between the shapes than in the gradual transitions mentioned above. Instead the shape of the cup is like that of two intersecting elongated troughs. One elongated trough extends perpendicular to the axial plane through the crests 41 at the lip of the cup. Throughout its length the elongated trough has the same shape as the shape in the axial plane.

Similarly, 90° from this cross section, the shape of the axial cross section through the valleys 42 is determined as described above. The same cross section is provided along an elongated trough perpendicular to the axial plane through the valleys 42.

The two elongated troughs intersect each other along lines 43 radiating from the corners of a square flat area 44 in the bottom of the cup. The upper edges of the intersecting elongated troughs are shaved to provide a more or less continuous lip between the crests and valleys 42.

Such an embodiment may be manufactured from a die or stamp which is the complement of the inside of the cup. Such a die or stamp is made by cutting the complement of the elongated troughs in orthogonal directions.

If somewhat greater flux extraction is desired from an embodiment somewhat as illustrated in FIGS. 5 and 6, two additional intersecting elongated troughs may be employed midway between the principle elongated troughs having shapes determined by the crests 41 and valleys 42 at the lip of the cup. In such an embodiment the shape of the desired secondary trough is determined by the same rules as described above for a lip height in between the higher and lower portions of the crests and valleys. This provides a shape intermediate between the shapes of the principal troughs. A die or stamp can then be made with orthogonal cuts of the complements of these secondary troughs 45° from the directions of the principal elongated troughs. This leaves an octagonal flat area in the bottom of the cup instead of the square area as illustrated in FIG. 6.

It will be apparent that additional intersecting troughs may be made intermediate between the ones just mentioned for further improvement of flux extraction. It will also be apparent that the completely smooth transition described hereinabove is essentially an infinite number of such intersecting troughs.

The non-axisymmetric flux extraction cup has been described divorced from other optical elements. It will be apparent that light concentrating reflectors, lenses and the like may be provided adjacent to the mouth of the cup for concentrating or redirecting light projected from the cup.

It will also be apparent that there are many modifications and variations of flux extraction cups which are possible in light of the description. For example, cups have been described with bilateral symmetry (FIG.4) and quadrilateral symmetry (FIG. 3) and other embodiments of non-axisymmetrical cups may be provided. Thus, a cup with trilateral symmetry might be desirable for some applications.

In some embodiments the flux extraction cup may be filled with a transparent epoxy or the like having a higher index of refraction than air. If so, and the transparent filling material has an interface with the air, suitable changes would be appropriate for determining the cup cutoff angles and projected lines for determining the shapes of the internal cup surface.

Reference is made herein to the lip of the cup. It should be understood that this may not be a physical lip but only a geometrical lip for purposes of determining the optical properties of the reflective surfaces. The cup may have additional structure beyond the "lip" which does not affect the optical characteristics.

Also, it should be noted that the higher lip may be truncated for ease of manufacture of a cup. The amount of light emitted from the surfaces of the LED at angles greater than $A_2$ which would be reflected from the portion of the higher wall surface above a transverse plane at the elevation of the lower lip 21 is rather small. Thus, the upper portion of the right wall above this plane could be omitted to make it easier to mold or stamp the cup without sacrificing a large amount of the efficiency. Most of the light would be within the cutoff angles $A_1$ and $A_2$ and such a compromise from the "ideal" design may be acceptable for practical considerations. Depending on the design parameters of the cup, the amount of light lost could be in the range of about 10%. Some of this light may be recaptured by optical elements subsequent to the flux extraction cup.

With such matters in mind it will be apparent that one skilled in the art may make many modifications and variations of the present invention within the scope of the appended claims.

What is claimed is:

1. A flux extractor cup for extracting light efficiently from a source positioned on an optical axis within an axially symmetrical virtual positioning envelope and for directing light emitted by the source within a solid flux path which is asymmetrical relative to the optical axis, the cup being asymmetrical with at least one high lip and one low lip, and comprising in one side of a longitudinal cross section through the high lip and the low lip:

a flat section located at the bottom of the cup and normal to the optical axis for attachment of the light source, the flat section having a diameter equal to a diameter of the positioning envelope;

a circular section extending from the flat section to a lower point located at an intersection with a line from the high cup lip through a nearest edge point of a top surface of the positioning envelope, the circular section having a constant radius and a center at the nearest edge point;

a lower parabolic section extending from the lower point to an upper point located at an intersection with a projection of the top surface of the positioning envelope, the lower parabolic section having a vertex at the lower point, an axis projecting through the nearest edge point and the lower point, and a focus at the nearest edge point; and an upper parabolic section extending from the upper point to the low cup lip, the upper parabolic section having a vertex at the low cup lip, an axis extending through the farthest edge point and parallel to the axis of the lower parabolic section, and a focus located at the farthest edge point of the top surface of the positioning envelope;

and on the other side of the longitudinal cross section through the high lip and the low lip:

a circular section extending from the flat section to a lower point located at an intersection with a line from the low cup lip through a nearest edge point of a top surface of the positioning envelope, the circular section having a constant radius and a center at the nearest edge point;

a lower parabolic section extending from the lower point to an upper point located at an intersection with a projection of the top surface of the positioning envelope, the lower parabolic section having a vertex at the lower point, an axis projecting through the nearest edge point and the lower point, and a focus at the nearest edge point; and an upper parabolic section, extending from the upper point to the high cup lip, the upper parabolic section having a vertex at the high cup lip, an axis extending through the farthest edge point and parallel to the axis of the lower parabolic section, and a focus located at the farthest edge point of the top surface of the positioning envelope;

wherein the cup has an interior surface that is specularly reflective.

2. A cup as in claim 1 wherein the light source is an LED.

3. A flux extractor cup for extracting light efficiently from an LED positioned on an optical axis within an axially symmetrical virtual positioning envelope and for directing light emitted by the LED within a flux path which is asymmetrical relative to the optical axis, the cup being asymmetrical with at least one high lip portion and one low lip portion;

a flat section located at the bottom of the cup and normal to the optical axis, the flat section having a width equal to a diameter of the positioning envelope;

an LED mounted on the bottom of the cup within the positioning envelope;

and comprising in at least one side of a first longitudinal cross section:

a circular section extending from the flat section to a lower point located at an intersection with a line from the opposite cup lip through a nearest edge point of a top surface of the positioning envelope, the circular section having a constant radius and a center at the nearest edge point;

a lower parabolic section extending from the lower point to an upper point located at an intersection of the cup surface with a projection of the top surface of the positioning envelope, the lower parabolic section having a vertex at the lower point, an axis projecting through the nearest edge point and the lower point, and a focus at the nearest edge point; and an upper parabolic section extending from the upper point to the nearer cup lip, the upper parabolic section having a vertex at the nearer cup lip, an axis extending through the farthest edge point and parallel to the axis of the lower parabolic section, and a focus located at the farthest edge point of the top surface of the positioning envelope;

and comprising in at least one side of a second longitudinal cross section different from the first longitudinal cross section:

a circular section extending from the flat section to a lower point located at an intersection with a line from the opposite cup lip through a nearest edge point of a top surface of the positioning envelope, the circular section having a constant radius and a center at the nearest edge point;

a lower parabolic section extending from the lower point to an upper point located at an intersection of the cup surface with a projection of the top surface of the positioning envelope, the lower parabolic section having a vertex at the lower point, an axis projecting through the nearest edge point and the lower point, and a focus at the nearest edge point; and an upper parabolic section extending from the upper point to the nearer cup lip, the upper parabolic section having a vertex at the nearer cup lip, an axis extending through the farthest edge point and parallel to the axis of the lower parabolic section, and a focus located at the farthest edge point of the top surface of the positioning envelope.

4. A flux extractor cup as recited in claim 3 wherein the high and low lip portions are opposite each other and the first and second longitudinal cross sections are in a common plane.

5. A flux extractor cup as recited in claim 3 wherein the high and low lip portions are 90° apart around the lip of the cup and the first and second longitudinal cross sections are through a high lip portion and a low lip portion respectively.

6. A flux extractor cup as recited in claim 3 wherein the high and low lip portions are 45° apart around the lip of the cup and the first and second longitudinal cross sections are through a high lip portion and a low lip portion respectively.

7. A flux extractor cup as recited in claim 3 wherein there are two high lip portions opposite each other, and two low lip portions opposite each other between the high lip portions, and the first and second longitudinal cross sections are through the two high lip portions and the two low lip portions, respectively.

8. A flux extractor cup as recited in claim 3 wherein there are four high lip portions evenly spaced around the lip of the cup and four low lip portions opposite each other and between the high lip portions, and the first and second longitudinal cross sections are through two high lip portions and two low lip portions, respectively.

9. A flux extractor cup as recited in claim 3 wherein there is a gradual transition between the shape of the upper parabolic section in the first cross section and the upper parabolic section in the second cross section, and there is a gradual transition between the shape of the lower parabolic section in the first cross section and the lower parabolic section in the second cross section.

10. A flux extractor cup as recited in claim 3 wherein the first cross section is through a pair of opposite high lip portions and the second cross section is through a pair of opposite low lip portions, the first cross section is perpendicular to the second cross section, and each cross section is in the form of an elongated trough extending to an intersection with the elongated trough for the other cross section.

11. A flux extractor cup for extracting light efficiently from an LED positioned on an optical axis within an axially symmetrical virtual positioning envelope, the cup having an inside surface comprising:

a flat section located at the bottom of the cup and normal to the optical axis, the flat section having a width equal to a diameter of the positioning envelope;

an LED mounted on the bottom of the cup within the positioning envelope;

and comprising in at least one side of a first longitudinal cross section:

a circular section extending from the flat section to a lower point located at an intersection with a line through a respective nearest edge point of a top surface of the positioning envelope at the cutoff angle at the opposite side of the cup, the circular section having a constant radius and a center at the nearest edge point;

a lower parabolic section extending from the lower point to an upper point located at an intersection of the cup surface with a projection of the top surface of the positioning envelope; and an upper parabolic section extending from the upper point to the nearer cup lip;

and comprising in at least one side of a second longitudinal cross section:

a circular section extending from the flat section to a lower point located at an intersection with a line through a nearest edge point of a top surface of the positioning envelope at the cutoff angle of the opposite side of the cup, the circular section having a constant radius and a center at the nearest edge point;

a lower parabolic section extending from the lower point to an upper point located at an intersection of the cup surface with a projection of the top surface of the positioning envelope; and an upper parabolic section extending from the upper point to the nearer cup lip; and wherein each lower parabolic section has a vertex at the respective lower point, a focus at the respective nearest edge point of the top surface of the positioning envelope, and an axis along a line through the respective nearest edge point of the top surface of the positioning envelope at the cutoff angle on the far side of the cup; and each upper parabolic section has an axis parallel to the axis of the lower parabolic section and through the respective farthest edge point of the top surface of the positioning envelope, a vertex on a line extending through the respective farthest edge point of the top surface of the positioning envelope at the cutoff angle on the near side of the cup, and a focus located at the farthest edge point of the top surface of the positioning envelope.

12. A flux extractor cup as recited in claim 11 wherein the second cross section is different from the first cross section and the cup has at least one smaller cutoff angle and one larger cutoff angle at a different location around the rim of the cup from the smaller cutoff angle for directing light emitted by the LED within a flux path which is asymmetrical relative to the optical axis.

* * * * *